US005967873A

United States Patent [19]

Rabinowitz

[11] Patent Number: 5,967,873

[45] Date of Patent: Oct. 19, 1999

[54] EMISSIVE FLAT PANEL DISPLAY WITH IMPROVED REGENERATIVE CATHODE

[76] Inventor: Mario Rabinowitz, 715 Lakemead Way, Redwood City, Calif. 94062

[21] Appl. No.: 08/909,259

[22] Filed: Aug. 11, 1997

Related U.S. Application Data

[62] Division of application No. 08/584,373, Jan. 11, 1996, Pat. No. 5,697,827.

[51] Int. Cl.[6] ..... H01J 9/02

[52] U.S. Cl. ..... 445/50; 204/192.11

[58] Field of Search ..... 445/50; 204/192.11

[56] References Cited

U.S. PATENT DOCUMENTS

| | | | |
|---|---|---|---|
| 3,118,077 | 1/1964 | Gabor | 313/7 |
| 3,244,990 | 4/1966 | Herb et al. | 328/252 |
| 3,510,712 | 5/1970 | Rabinowitz et al. | 313/7 |
| 3,588,593 | 6/1971 | Rabinowitz et al. | 315/108 |
| 4,121,130 | 10/1978 | Gange | 313/302 |
| 4,435,672 | 3/1984 | Heynisch | 315/366 |
| 4,577,133 | 3/1986 | Wilson | 313/103 |
| 4,618,801 | 10/1986 | Kakino | 313/495 |
| 4,719,388 | 1/1988 | Oess | 315/169.1 |
| 4,857,799 | 8/1989 | Spindt et al. | 313/497 |
| 4,874,981 | 10/1989 | Spindt | 313/309 |
| 5,015,912 | 5/1991 | Spindt et al. | 313/495 |
| 5,064,396 | 11/1991 | Spindt | 445/50 |
| 5,089,292 | 2/1992 | MaCaulay et al. | 427/78 |
| 5,235,244 | 8/1993 | Spindt | 313/495 |
| 5,272,419 | 12/1993 | Park | 315/169.1 |
| 5,347,201 | 9/1994 | Liang et al. | 315/366 |
| 5,424,605 | 6/1995 | Lovoi | 313/422 |
| 5,462,467 | 10/1995 | Macaulay et al. | 445/50 |
| 5,463,271 | 10/1995 | Geis et al. | 313/346 |

*Primary Examiner*—Kenneth J. Ramsey

[57] ABSTRACT

Method and apparatus are presented for the generation, regeneration, and transplantation of field enhancing whiskers to provide for an improved cathode in flat panel displays in particular, and in other applications. Such applications comprise devices in which there is an emissive cathode structure for producing electrons. There are dear advantages for the instant invention in the case of a flat panel display which requires a relatively large cathode area, because the present invention avoids excessive power loss due to radiation and conduction loss by permitting operation of the cathode at a significantly lower temperature than if it operated solely as a thermionic emitter. The combination of moderately elevated temperature and enhanced electric field allows the advantages of thermo-field assisted emission.

20 Claims, 3 Drawing Sheets

EMISSIVE FLAT PANEL DISPLAY WITH IMPROVED REGENERATIVE CATHODE

This is a divisional of application Ser. No. 08/584,373 filed Jan. 11, 1996, now U.S. Pat. No. 5,697,827.

BACKGROUND OF THE INVENTION

1. Field of the Invention

There is presently intense interest in flat panel displays not only to replace the ordinary cathode ray tube but also to go beyond the limits of liquid crystal displays. A flat panel display is one in which the display area is maximized and the operating volume of the device minimized to yield a maximization of display area to volume. An emissive flat panel display is one in which electrons are emitted from the cathode, and then directed to discrete positions on a luminescent screen. The instant invention relates to a greatly improved emissive cathode which combines thermionic emission with a moderately high to high electric field for barrier reduction and field emission in a novel structure that is less expensive to manufacture and more rugged than its existing counterparts. The combination of thermionic emission and a moderate electric field is called Schottky emission. Since the electric fields in this invention go from moderate to high, the emission can greatly surpass Schottky emission.

Furthermore the present invention provides method and apparatus for generation and regeneration of sharp asperities to increase the useful lifetime of the cathode. These asperities (whiskers) are responsible for providing the field emission component of the current. A deficit of extant field emission flat panel displays is that when the asperities lose their sharpness or length (tips become dulled), sufficient emission ceases, the asperity cannot be restored, and the whisker becomes ineffective.

As practiced in the present invention, it is possible to reduce the effective work function by about 1 eV due to the Schottky reduction in barrier height. As is shown in the accompanying tables, about a 1 eV decrease in work function can increase the current density by as much as $\sim 10^6$. The actual increase is even greater than this because Schottky modified the equation for thermionic emission to include only the effect of barrier height reduction by a moderate field. He did not include the effects of tunneling through a barrier that has been appreciably thinned by a high electric field. For a very high electric field, tunneling effects produce an even much higher emission rate; and the effects of combined thermionic emission and field emission are much more complicated than mere Schottky emission.

Whereas, the improved cathode of the immediate invention is presented in the context of flat panel displays, it may be utilized in a number of other applications, with or without the regenerative capability. Such applications comprise devices in which there is an emissive cathode structure for producing electrons. There are clear advantages for the instant invention in the case of a flat panel display which requires a relatively large cathode area, because the present invention avoids excessive power loss due to radiation and conduction loss by permitting operation of the cathode at a significantly lower temperature than if it operated solely as a thermionic emitter. Additionally the moderate to high electric field mitigates against space charge limitations of the current. There are also clear advantages for the present invention over purely field emitting cathodes in a flat panel display: 1) as there is an additional control over the emission current; 2) the effects of asperity tip dulling are mitigated both by regeneration and separate control of emission; 3) expensive processes for making a precisely similar and precisely arranged multitude array of field emitting cathodes are avoided; and 4) the immediate invention results in a more robust cathode than the field emission cathode in which microscopic spacing between anode and cathode and its maintenance is critical.

DEFINITIONS

"Flat panel display" is a video display in which the ratio of display area to the operating volume is maximized relative to other types of displays.

"Thermionic emission" is the liberation of electrons from a heated electrical conductor. The electrons are essentially boiled out of a material when they obtain sufficient thermal energy to go over the potential energy barrier of the conductor. This is somewhat analogous to the removal of vapor from a heated liquid as in the boiling of water.

"Work function" is the minimum energy needed to remove an electron at 0 K from a metal. At higher temperatures, the work function for most electrons does not differ appreciably from this low temperature value. (More rigorously, the work function is the difference between the binding energy and the Fermi energy of electrons in a metal.)

"Electric field" or "electric stress" refers to a voltage gradient. An electric field can produce a force on charged objects, as well as neutral objects. The force on neutral objects results from an interaction of the electric field on intrinsic or induced electric polar moments in the object.

"Schottky emission" is the enhancement of thermionic emission from a cathode resulting from the application of a moderate accelerating electric field $\sim 10^5$V/cm to $\sim 10^6$V/cm. The electric field lowers the barrier height, and hence decreases the effective work function. The electric field is not high enough to sufficiently thin the barrier width, so that field emission is not an appreciable part of the emission at moderate electric fields.

"Field emission" or "cold emission" is the release of electrons from the surface of a cathode (usually into vacuum) under the action of a high electrostatic field $\sim 10^7$ V/cm and higher. The high electric field sufficiently thins the potential energy barrier so that electrons can quantum-mechanically tunnel through the barrier even though they do not have enough energy to go over the barrier. This is why it is also known as "cold emission" as the temperature of the emitter is not elevated.

"Thermo-field assisted emission" involves thermionic emission in the presence of a moderate to high electric field so that it includes the realms of both Schottky emission and field emission. At high electric fields, the emission rate is much higher than just from Schottky emission as the barrier is not only decreased in height, but also in width.

"Whisker" is the generic term used herein for a microprotrusion or asperity on the surface of a material with a large aspect ratio of height to tip radius.

"Nascent whisker" is a relatively small microprotrusion or asperity on the surface of a material that has the potential of becoming a whisker.

"Macroscopic electric field" is the applied electric field on the basis of the imposed voltage and the gross (macroscopic) geometry of the electrodes, and which is relevant as long as one is not too near the electrodes.

"Enhanced or microscopic electric field" is the electric field enhanced by whiskers very near the electrodes based upon the local (microscopic) geometry on the surface of the electrodes.

"Enhancement factor" is the ratio of the microscopic to the macroscopic electric field, and denoted herein by the symbol β.

"Penultimate electron extractor grid" is an extra grid, novel to the instant invention, which surrounds each wire or ribbon of the cathode array to augment the enhancement of the electric field at the wire or ribbon for the purpose of either greater electron emission, or whisker growth.

"Generative or generation" herein denotes either initial growth or regenerative growth of a whisker.

"Nanotubes" are graphitic microtubule structures of atomic thickness, of the order of 10 Å inside diameter, which have enormous tensile strength, and can pull molecules inside them by capillary action. Nanotubes are named for their cylindrical hollow form with nanometer size diameters. They may have single or multi-walled structure. Nanotubes can be produced by the pound.

SUMMARY OF THE INVENTION

There are many aspects and applications of this invention. Primarily this invention deals with the broad general concept of method and apparatus for a cathode source of thermo-field assisted emission of electrons, and regeneration of the electric field enhancing whisker component of this source. In particular, such a cathode source has an important and unique application to flat panel displays.

One substantive aspect of thermo-field assisted electron emission is the enhancement of the electric field of a thermionic emitter so that a given current emission can take place at a substantially lower temperature than if the process were solely thermionic emission. Thus the enhanced electric field greatly assists the thermionic emission. Concomitantly, the thermal aspect is another substantive aspect in which the moderately elevated temperature of the cathode assists emission due to the lowered barrier (effectively decreased work function) and the tunneling through the barrier produced by the electric field. Hence the two aspects help each other in working together to produce notably higher emisssion rates than each alone. Furthermore, the combination of thermal elevation and field elevation capability in the same cathode permits a novel regeneration of electric field enhancing whiskers on the cathode.

Method and apparatus for distinctively different ways of producing whiskers are taught herein. One is by temperature elevation of the cathode by electron bombardment or resistive heating in a high electric field, either of which can be done in situ. Another is by ion sputtering of the cathode. Another is by electric field assisted whisker bonding to the cathode. Further ways are taught in conjunction with the figures. Although whiskers are good for field enhancing, as with most things too much of a good thing is undesirable. Thus we teach that there is a maximum density of whiskers, beyond which not only are whiskers unadvantageous but actually are disadvantageous.

It is a general object of the instant invention to increase the current density of emitted electrons from a cathode by means of thermo-field assisted emission.

Another object is to cause the surface of the cathode to be covered with whiskers in order to enhance the electric field at the cathode.

Another object is to regenerate whiskers that have become dulled.

Other objects and advantages of the invention will be apparent in a description of specific embodiments thereof, given by way of example only, to enable one skilled in the art to readily practice the invention as described hereinafter with reference to the accompanying drawings.

In accordance with the illustrated preferred embodiments, method and apparatus are presented that are capable of producing, maintaining, and regenerating a high electric field environment for a thermionic cathode. This will permit it to have a long and trouble-free life in a wide variety of applications, and in particular as a cathode for a flat panel display.

DETAILED DESCRIPTION OF THE PREFERRED EMBODIMENTS

Figure 1:
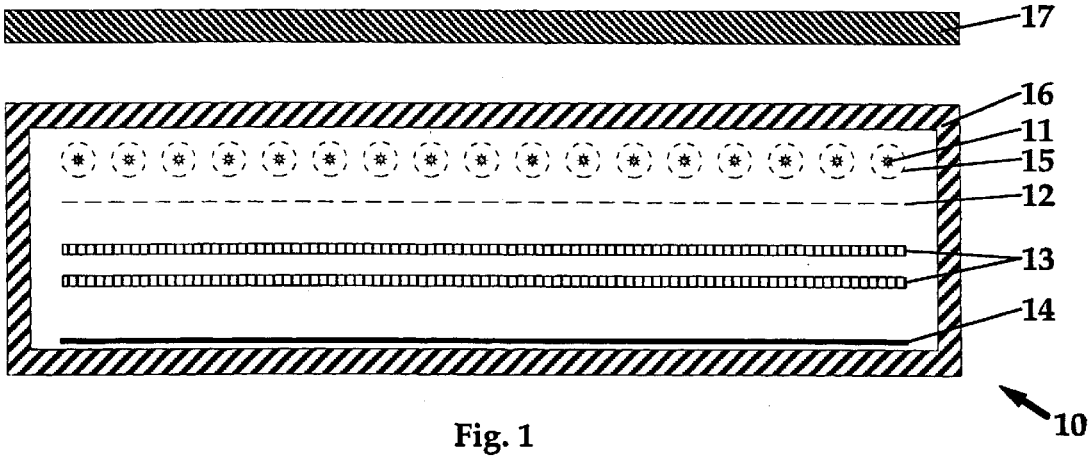
FIG. 1 is a top cross-sectional view of an emissive flat panel display which illustrates the cathode of the instant invention, showing the physical relationship between the various elements of the display.

FIG. 1 is a top cross-sectional view of an emissive flat panel display 10 in accordance with the instant invention. Electrons from whisker covered wires 11 forming a cathode array are accelerated by a highly transparent ultimate extractor grid 12 toward an addressing grid 13. The addressing grid 13 controls the positions upon which electrons will impinge on a phosphor screen 14 as prescribed by the addressing circuitry 17. A highly transparent electric-field-enhancing penultimate extractor grid 15 which is novel to the instant invention surrounds each wire 11 of the cathode array. Components 11, 12, 13, 14 and 15 are inside an evacuated glass envelope 16. The addressing circuitry 17 is outside the envelope 16, unless it is sufficiently miniaturized to be contained inside. A transparent material such as glass is needed adjacent to the phosphor screen 14 so that the image that is formed by electron excitation may be seen. However, it is optional as to whether the remainder of the envelope 16 is glass or some other material. For some purposes, the envelope 16 may be metallic as long as the various components are electrically isolated from it.

Figure 2:
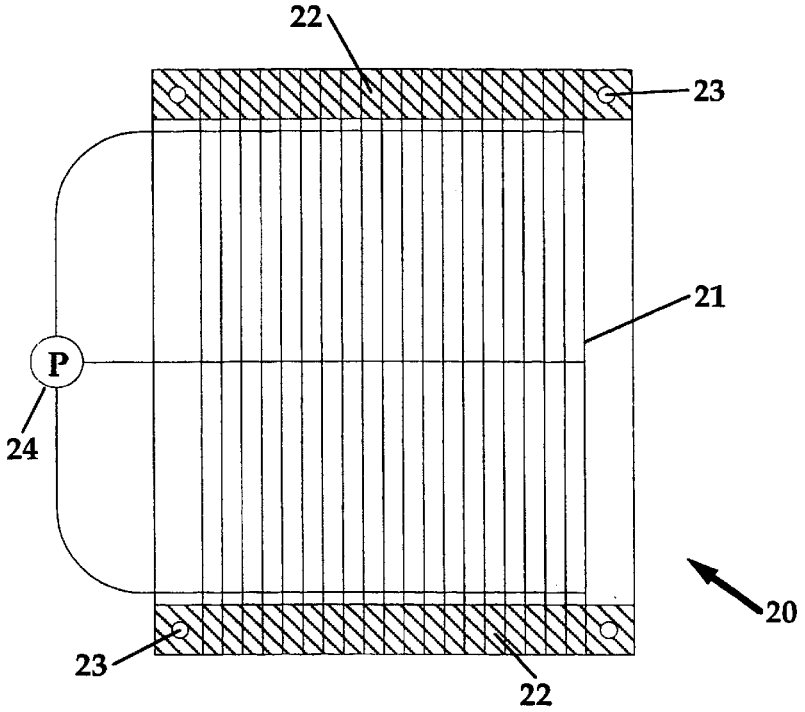
FIG. 2 is a planar view of an emissive cathode array depicting general features common to various embodiments illustrated in the succeeding figures.

FIG. 2 is a planar view of an emissive cathode array 20 in which the penultimate extractor grids of FIG. 1 which surround each wire are not shown for the purpose of increased clarity in showing the wire structure. Cathode wires 21 are shown in parallel connection so that burn out of individual wires will not disrupt operation of the array 20, and to minimize the voltage gradient or voltage drop along the length of the wires 21. The wires 21 are supported by insulators 22 at top and bottom. The structure is attached by posts 23 to the envelope 16 of FIG. 1. The wires 21 are shown in vertical alignment although horizontal alignment may also be used. The wires 21 are heated by means of the power source 24 for the purpose of producing thermionic emission. The increased temperature will cause them to expand so that it is desirable to have them spring loaded at their ends to keep them from sagging.

The current density J in A/cm$^2$ of thermionically emitted electrons is given by the Richardson-Dushman equation, $$J=A_O(1-\rho)T^2e^{-\phi/kT}, \tag{1}$$

where $A_O$ is 120.4 A/(cm$^2$–K$^2$), T is the cathode temperature in K, $\phi$ is the electron work function of the cathode, and k is the Boltzmann constant. A quantum-mechanical refinement which takes into consideration the fact that an electron approaching the metal surface may be reflected back into the metal by the potential barrier even if it has enough energy to escape is given by $\rho$, an average reflection coefficient. For many metals $\rho\sim\frac{1}{2}$.

Table 1 illustrates a few temperatures needed for a commonly used thoriated tungsten cathode of 2.77 eV work function to achieve the indicated thermionic emission current density, J.

TABLE 1

| 2.77 eV Work Function | | |
|---|---|---|
| T, ° C. | T,K | J,A/cm$^2$ |
| 527 | 800 | $1.47\times10^{-10}$ |
| 800 | 1073 | $7.03\times10^{-6}$ |
| 1327 | 1600 | $2.99\times10^{-1}$ |

Figure 3:
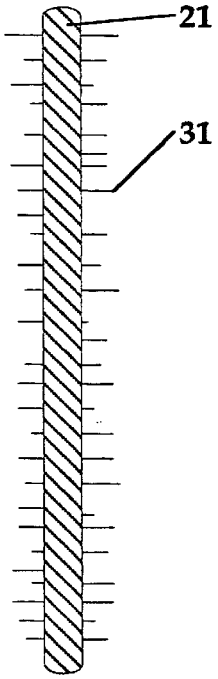
FIG. 3 is a longitudinal cross-sectional view of a single wire covered with whiskers.

FIG. 3 is a longitudinal cross-section of part of a cathode wire 21, illustrating its surface covered with whiskers of varying sizes.

Figure 4:
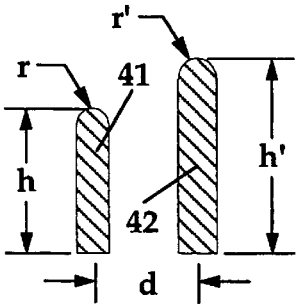
FIG. 4 is a longitudinal cross-sectional view showing two whiskers.

FIG. 4 depicts a longitudinal cross-section of two such whiskers. One whisker 41 is of height h and tip radius r. The other whisker 42 is of height h' and tip radius r'. As long as the whisker height is much greater than the tip radius, the electric field enhancement at the tip of the whisker is $$\beta\approx h/r \tag{2}$$

to a good approximation independent of the shape of the whisker (e.g. hemispherically capped whisker as shown, cone, spheroid, etc.). As long as the whisker height is small compared with the macrosopic dimensions of the apparatus, the electric field enhancement is independent of the size of the whiskers and just depends on the aspect ratio h/r. Thus the two whiskers may have the same field enhancement if h/r=h'/r'.

The enhanced microscopic electric field at the tip of a whisker is $$E_{mic}=\beta E_{mac}, \tag{3}$$

where $E_{mac}$ is the macroscopic electric field that would be present at the tip location if the whisker weren't there, as long as the whisker separation d is not too small. For very close whisker separations, the enhancement decreases. A large density (close separation) of sharp whiskers is desirable to increase the total emission current as long as the separation between whiskers $$d>10r. \tag{4}$$

At separations (d) between whiskers greater than 10 tip radii (10r), the enhanced microscopic field of each whisker falls off quickly enough with distance that it hardly affects the microscopic field of an adjoining whisker. Within the approximation d>10r, the total current is approximately proportional to the total number of sharp whiskers. One may understand why too high a density of whiskers is disadvantageous by noting that in the limit of contiguous whiskers of the same height, there is no enhancement of the electric field.

Figure 5:
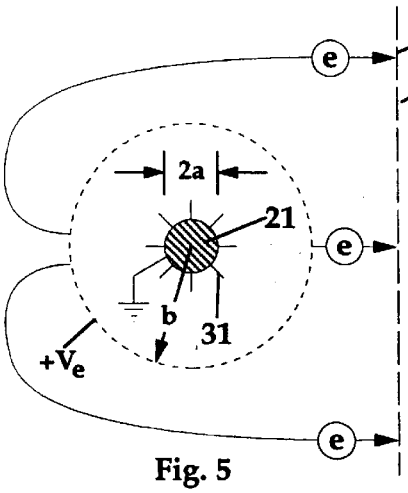
FIG. 5 is a transverse cross-sectional view of a whisker-covered emissive wire surrounded by a transparent mesh, coaxial cylinder, penultimate electron extractor grid with electrons directed to the ultimate extractor grid.

FIG. 5 shows a transverse cross-section of the cathode wire 21 and whiskers 31 of FIG. 3, surrounded by a coaxial, highly transparent, cylindrical penultimate extractor grid 51. Electrons coming from the cathode 21 are accelerated through the penultimate extractor grid 51. The ultimate extractor grid 12 has applied to it a voltage $+V_E$ which is > than the extractor voltage $+V_e$ on the penultimate extractor grid 51, in accord with the Langmuir-Child law to be discussed shortly. The ultimate extractor grid 12 accelerates the emitted electrons towards the addressing grids 13 and 14 of FIG. 1. This ultimate extractor grid 52 not only directs those electrons that are initially aimed toward it, it also diverts those electrons which are aimed away from it. This is because the electric field lines from the penultimate extractor grid 51 either go directly toward the grid 51 or bend around toward the grid 51 as shown. The cylindrical wire 21 and coaxial cylinder 51 may be held in coaxial alignment by means of occasional dielectric spacers, or simply because the segments of wire 21 and cylinder 51 are short enough between (parallel) connection points to easily maintain coaxial alignment.

The macroscopic electric field between the two coaxial cylinders as defined by the cathode wire 21 and the grid 51 is given by $$E_{mac}=\frac{V_e}{R\ln\left(\frac{b}{a}\right)}, \tag{5}$$

where $V_e$ is the positive voltage of the extractor grid 51 with respect to the cathode wire 21, R is the radial distance (measured from the center of the wire) to the point at which the macroscopic electric field is to be determined, ln is the Naperian or natural logarithm to the base e, b is the radius of the extractor grid 51, and a is the radius of the wire. The enhanced microscopic electric field at the tip of a whisker in this coaxial cylindrical geometry is $$E_{mic} = \beta E_{mac} = \frac{\beta V_e}{a\ln\left(\frac{b}{a}\right)}, \tag{6}$$

where the radial position of the whisker tip is R=a+h≈a, since h<<a.

Some numbers in eqs. (5) and (6) illustrate the relatively high electric fields that are achievable at the cathode, R=a, with the application of only moderate voltages as shown in Tables 2, 3, and 4.

TABLE 2

Macroscopic and Microscopic Electric Fields for Coaxial Cylinders (For a = $10^{-3}$ inch = $2.54 \times 10^{-3}$ cm = $2.54 \times 10^{-5}$ m, $V_e$ = 100 V and β = 1000.)

| b,inch | b,cm | $E_{mac}$,V/cm | $E_{mic}$,V/cm |
|---|---|---|---|
| $10^{-1}$ | $2.54 \times 10^{-1}$ | $8.56 \times 10^{3}$ | $8.56 \times 10^{6}$ |
| $2 \times 10^{-1}$ | $5.08 \times 10^{-1}$ | $7.44 \times 10^{3}$ | $7.44 \times 10^{6}$ |
| $5 \times 10^{-1}$ | 1.27 | $6.34 \times 10^{3}$ | $6.34 \times 10^{6}$ |
| 1 | 2.54 | $5.70 \times 10^{3}$ | $5.70 \times 10^{6}$ |

TABLE 3

Macroscopic and Microscopic Electric Fields for Coaxial Cylinders (For a = $3 \times 10^{-3}$ inch = $7.62 \times 10^{-3}$ cm = $7.62 \times 10^{-5}$ m, $V_e$ = 100 V and β = 1000.)

| b,inch | b,cm | $E_{mac}$,V/cm | $E_{mic}$,V/cm |
|---|---|---|---|
| $10^{-1}$ | $2.54 \times 10^{-1}$ | $3.74 \times 10^{3}$ | $3.74 \times 10^{6}$ |
| $2 \times 10^{-1}$ | $5.08 \times 10^{-1}$ | $3.12 \times 10^{3}$ | $3.12 \times 10^{6}$ |
| $3 \times 10^{-1}$ | $7.62 \times 10^{-1}$ | $2.84 \times 10^{3}$ | $2.84 \times 10^{6}$ |
| $5 \times 10^{-1}$ | 1.27 | $2.56 \times 10^{3}$ | $2.56 \times 10^{6}$ |
| 1 | 2.54 | $2.26 \times 10^{3}$ | $2.26 \times 10^{6}$ |

TABLE 4

Macroscopic and Microscopic Electric Fields for Coaxial Cylinders (For a = $3 \times 10^{-3}$ inch = $7.62 \times 10^{-3}$ cm = $7.62 \times 10^{-5}$ m, $V_e$ = 300 V and β = 1000.)

| b,inch | b,cm | $E_{mac}$,V/cm | $E_{mic}$,V/cm |
|---|---|---|---|
| $10^{-1}$ | $2.54 \times 10^{-1}$ | $1.12 \times 10^{4}$ | $1.12 \times 10^{7}$ |
| $2 \times 10^{-1}$ | $5.08 \times 10^{-1}$ | $9.36 \times 10^{3}$ | $9.36 \times 10^{6}$ |
| $3 \times 10^{-1}$ | $7.62 \times 10^{-1}$ | $8.52 \times 10^{3}$ | $8.52 \times 10^{6}$ |
| $5 \times 10^{-1}$ | 1.27 | $7.68 \times 10^{3}$ | $7.68 \times 10^{6}$ |
| 1 | 2.54 | $6.76 \times 10^{3}$ | $6.76 \times 10^{6}$ |

The presence of a moderate electric field, ~$10^7$V/m to ~$10^8$V/m, lowers the barrier height of a thermionic cathode, and hence decreases the effective work function as given by the equation for Schottky emission.

$$J = A_O(1-\rho)T^2 e^{-[\phi-\Delta\phi]/kT}, \tag{7}$$

where the symbols are the same as in equation (1), and the decrease in work function is $$\Delta\phi = \frac{1}{2}\left[\frac{qE}{\pi\varepsilon_o}\right]^{\frac{1}{2}} = 3.79\times 10^{-5}[E]^{\frac{1}{2}}\ \text{eV}. \tag{8}$$

In equation (8), Δϕ is in eV for E in V/m, where q is the charge of an electron in Coulombs, and $\epsilon_O$ is the permittivity of free space (the units here and in many of the other equations have been chosen for practicality). In addition to the reduction in the work function, the electric field rounds the barrier. The rounded barrier reduces the reflection coefficient ρ, so that the transmission of escaping electrons goes up increasing the emission rate. For electric fields ~$10^9$V/m and higher, the emission rate is much greater than just from Schottky emission as the barrier is not only decreased in height, but also in width, and we are in the realm of thermo-field assisted emission.

Table 5 illustrates the decrease in work function, Δϕ, for various electric fields ranging from moderate to high.

TABLE 5

Decrease in Work Function for Various Electric Fields

| E,V/cm | E,V/m | Δϕ |
|---|---|---|
| $10^{3}$ | $10^{5}$ | $1.2 \times 10^{-2}$ |
| $10^{4}$ | $10^{6}$ | $3.8 \times 10^{-2}$ |
| $10^{5}$ | $10^{7}$ | 0.12 |
| $10^{6}$ | $10^{8}$ | 0.38 |
| $5 \times 10^{6}$ | $5 \times 10^{8}$ | 0.85 |
| $10^{7}$ | $10^{9}$ | 1.2 |

As can be seen from Table 5, there is a negligible decrease in work function for fields below $10^6$V/m. For moderate fields ~$10^7$V/m to ~$10^8$V/m, there is a meaningful decrease in work function of greater than 0.1 eV. For fields in excess of $10^8$V/m, not only is there a large decrease in work function, but a sizable amount of additional current is emitted as the domain of thermo-field assisted emission is entered.

Tables 6 to 10 illustrate the temperatures needed for various work function cathodes to achieve the indicated thermionic emission current density, J. The work function of tungsten is approximately 4.5 eV. Since the melting point of tungsten, $T_{melt}$=3370° C.=3643 K, it is possible to achieve reasonably high current densities for tungsten by going to 2327° C. and beyond as shown in Table 6. However, this is at the cost of a large radiation power loss due to the high temperature.

THERMIONIC EMISSION CURRENT DENSITY

TABLE 6

| $\phi$ = 4.5 eV Work Function | | |
|---|---|---|
| T, ° C. | T,K | J,A/cm$^2$ |
| 527 | 800 | $1.8 \times 10^{-21}$ |
| 800 | 1073 | $5.4 \times 10^{-14}$ |
| 1327 | 1600 | $1.1 \times 10^{-6}$ |
| 2327 | 2600 | $7.8 \times 10^{-1}$ |

TABLE 7

| $\phi$ = 3.7 eV Work Function | | |
|---|---|---|
| T, ° C. | T,K | J,A/cm$^2$ |
| 527 | 800 | $1.97 \times 10^{-16}$ |
| 800 | 1073 | $2.99 \times 10^{-10}$ |
| 1327 | 1600 | $3.49 \times 10^{-4}$ |

TABLE 8

| $\phi$ = 3.5 eV Work Function | | |
|---|---|---|
| T, ° C. | T,K | J,A/cm$^2$ |
| 527 | 800 | $3.70 \times 10^{-15}$ |
| 800 | 1073 | $2.55 \times 10^{-9}$ |
| 1327 | 1600 | $1.47 \times 10^{-3}$ |

TABLE 9

| $\phi$ = 2.5 eV Work Function | | |
|---|---|---|
| T, ° C. | T,K | J,A/cm$^2$ |
| 527 | 800 | $7.21 \times 10^{-9}$ |
| 800 | 1073 | $1.26 \times 10^{-4}$ |
| 1327 | 1600 | 2.07 |

TABLE 10

| $\phi$ = 1.5 eV Work Function | | |
|---|---|---|
| T, ° C. | T,K | J,A/cm$^2$ |
| 527 | 800 | $1.41 \times 10^{-2}$ |
| 800 | 1073 | 6.26 |
| 1327 | 1600 | $2.91 \times 10^{3}$ |

The thermionic emission current density Tables 1, and 6 through 10 clearly show that a decrease in work function of ~1 eV (as can be achieved by the application of a high electric field, cf. Table 5) can significantly increase the current density and hence the current by factors ~$10^5$ to $10^6$ at the lower temperatures, and ~$10^3$ at the higher temperatures.

Besides increasing the emission rate from a thermionic emitter, there is an additional advantage to the application of a sizable electric field. The current collected at the anode can never be greater than the emission current, but it may be less due to space-charge limitation. The Langmuir-Child law for concentric cylinders yields $$I = 14.7 \times 10^{-6} \frac{lV^{3/2}}{bL^2} \text{ amp,} \tag{9}$$

where l is the length of the cylinders, V is the voltage between the cylinders, b is the radius of the anode, and L is a function of ln(b/a) where a is the radius of the cathode. L~1 for b/a~10 and varies slowly for larger ratios. A higher electric field for all geometries permits collection of the emitted electrons so that the current is only emission limited rather than space charge limited. This is fortuitous, as sometimes different physical requirements may be competing or even conflicting, but in this case they are harmonious.

Figure 6:
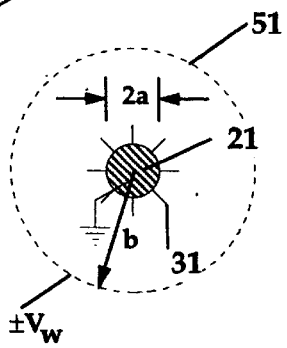
FIG. 6 is a transverse cross-sectional view of the cathode element of FIG. 5, operating in a whisker growing and/or emissive checking mode.

FIG. 6 shows a transverse cross-section of the wire 21 and whiskers 31 of FIG. 5 in a whisker generative or regenerative (growing) mode, wherein the coaxial cylindrical grid 51 may be at a positive or negative voltage $\pm V_W$ with respect to the wire 21. During the period of whisker regeneration, the temperature of the wire 21 is elevated to above normal temperature by routine resistive heating of the wire to increase the whisker growth rate. The period of whisker regeneration is relatively short compared with the periods of normal operation, so that the greater heat loss at the elevated temperatures is not a serious problem. The preferred temperature range is between 0.5 and 0.8 of the melting temperature of the wire, $T_{melt}$, on an absolute temperature scale such as degrees Kelvin, K. At lower than 0.5 $T_{melt}$, the growth rate is relatively slow. At greater than 0.8 $T_{melt}$, there are two problems. One is that the temperature is close to the melting point of the material and there is danger of burning out the wire. The other relates to the increased vapor pressure with temperature elevation as will be discussed next.

As an example let's consider tungsten, whose melting point is 3643 K (3370° C.). At 0.5 $T_{melt}$=1822 K (1549° C.), the vapor pressure of tungsten is ~$10^{-12}$ torr, which is extremely low. At 0.6 $T_{melt}$=2186 K (1913° C.), the vapor pressure of tungsten is only $2\times10^{-10}$ torr, which is very low. At 0.8 $T_{melt}$=2914 K (2641° C.), the vapor pressure of tungsten is $2\times10^{-5}$ torr, which is sufficiently low to avoid a gas discharge or arcing. A gaseous discharge or arcing problem can be as serious a problem as burnout of the wire 21. In order to prevent this problem, a pressure $<10^{-4}$ torr must be maintained to avoid gas discharge or arcing.

Therefore for high vapor pressure materials, rather than the temperature criterion of elevating the temperature to between 0.5 $T_{melt}$ and 0.8 $T_{melt}$, the temperature should be elevated to no higher than a temperature which produces a total pressure no greater than $10^{-4}$ torr. With a pressure of $10^{-4}$ torr or less, the mean free path for ionizing collisions is too long to produce an electrical discharge, unless the voltage is made very high e.g. in the tens of kV. (See for example the article by Mario Rabinowitz on "Electrical Insulation" in the 1992 McGraw-Hill Encyclopedia of Science and Technology pp. 94–100.) In addition to avoiding electrical breakdown by gas discharge or arcing, keeping the vapor pressure lower than $10^{-4}$ torr will also prevent the loss of materials that have been added to the cathodic wire 21 to give it a low work function. Evaporative loss of tungsten during the relatively short period devoted to whisker growth is not a problem due to the very low vapor pressure of tungsten. Even at a temperature as high as 2914K, the evaporation rate of tungsten is only $3.3\times10^{-7}$ gm/cm$^2$ sec.

Although temperature elevation can be achieved by the emission process itself (localized resistive heating of emitting cathodic whiskers by the emission current, and even localized spot heating on the anode due to the microscopic electron beams emanating from the whiskers), it is preferable to control the heating on a macroscopic scale by resistive heating of the wires as shown in FIG. 2, or by gross electron bombardment as will be described in conjunction with FIG. 11. Release of internal stress inside a material, due for example to screw dislocations, can produce whiskers. However, high temperature is only one of the ingredients needed for growing whiskers.

Application of an electric field to the wire 21 by application of voltage to the grid 51, is an important component of the whisker growing process which may be used by itself or preferably in combination with the heating of the wire 21. Unless a surface has been especially treated to make it microscopically smooth, it will generally be covered with small microprotrusions which herein are called nascent whiskers. The tensile stress on a nascent whisker is $\tau \sim \epsilon_O E_{mic}^2 \approx \epsilon_O \beta^2 E_{mac}^2$. By increasing the macroscopic electric field $E_{mac}$ so that $E_{mic} \sim 10^7$ V/cm ($10^9$ V/m), then $\tau \sim 10^7$ N/m$^2 \approx 10^3$ lb/in$^2$. Although this is small compared with the tensile strength at ambient temperature of many materials, the elevated temperature appreciably decreases the tensile strength, and the whisker will grow (extrude). As the whisker grows, the tensile stress increases as the square of the aspect ratio, $\beta^2 \approx (h/r)^2$, so that the increased tensile stress causes the whisker to grow more rapidly. As this happens the applied voltage $V_W$ may be decreased. It is important to stay below the breakdown voltage, i.e. to keep $E_{mac}$ below the electrical breakdown field, which in vacuum occurs at a decreasing field strength for larger gaps. (See for example the article by Mario Rabinowitz on "Electrical Breakdown in Vacuum: New Experimental and Theoretical Observations" in the journal Vacuum, 15, pp. 59 to 66, 1965.) When $E_{mic}$ approaches $10^8$ V/cm, then $\tau \sim 10^9$ N/m$^2 \approx 10^5$ lb/in$^2$, which is comparable to or greater than the tensile strength of many metals. For example, the tensile strength of tungsten is $5.9 \times 10^5$ lb/in$^2$. Tungsten has an unusually high tensile strength. For comparison, the tensile strength of steel varies between $4.2 \times 10^4$ to $4.6 \times 10^5$ lb/in$^2$. Therefore to augment whisker growth, the preferred range of enhanced electric field $E_{mic}$ is between $10^7$ V/cm and $10^8$ V/cm. In terms of tensile stress, this translates to a preferred range between $10^3$ lb/in$^2$ and $10^5$ lb/in$^2$.

The experimental evidence is that it is unavoidable for whiskers to become dulled (truncated) during long periods of emission due to surface diffusion and various other processes. Dulling is particularly a problem for very fine whiskers where due to the high surface to volume ratio at the tip, the number of bonds holding the surface atoms is smaller, the melting point at the tip is lower, and the evaporation rate from the tip is relatively higher than from the bulk material. The whisker tips will generally be at a higher temperature than the base of the whisker and the wire bulk due to emissive resistance heating of the whisker and thermal isolation of the tips. This is true despite the fact that it is possible for cooling to take place during emission, but not as practiced in the instant invention. In thermionic emission, emitted electrons carry away the work function energy which may be interpreted as the latent heat of evaporation of the electrons. However resistive heating (by thermionically emitted electrons) of whiskers dominates evaporative cooling for all but very short whiskers. Even without resistive heating, the field emission of an electron may lead to either cooling, no energy change, or heating depending on whether the energy level from which it is emitted is above, equal to, or below the Fermi level. However, resistive heating (by field emitted electrons) of a whisker is unavoidable, and again basically resistive heating of whiskers dominates emissive cooling for all but very short whiskers.

Whisker regeneration is imperative for a long and trouble-free cathode lifetime. From the analysis given above, it is clear that it is easiest to regenerate whiskers while they are still long (have a large enhancement factor). This is also desirable so that power input does not have to be increased very much in heating the cathode wire 21 to a higher temperature to compensate for whiskers that become dull during emission. Therefore it is most advantageous to automatically go into the whisker regeneration mode during the off periods of the device while only a small amount of regeneration is required for only a short period of time. Application of the radial electric field serves to align the whiskers in the direction of the electric field here and for whisker growth in FIGS. 9 and 11 as the electrostatic field on a whisker exerts a force on the whisker to align it parallel to the field.

It is possible to determine the enhancement factor of the dominant whiskers and stop the regeneration process at a predetermined level of emission or enhancement as desired. This is best done with the cathode at ambient temperature so that it emits in purely the field emission mode as given by the Fowler-Nordheim equation:

$$J_F = \frac{1.54 \times 10^{-6} \beta^2 E^2}{\phi t^2(y)} \exp\left[-6.83 \times 10^7 \frac{\phi^{3/2} v(y)}{\beta E}\right], \tag{10}$$

where $J_F$ is the field emitted current density in A/cm$^2$, $\phi$ is the work function in electron volts (eV), E is the macroscopic electric field in V/cm, $\beta$ is the enhancement factor. Nordheim introduced the elliptic function v(y) to correct for the image force on the electrons, and t(y) is another closely related elliptic function, with the parameter $$y = 3.795 \times 10^{-4} \frac{(\beta E)^{1/2}}{\phi}.$$

(A simpler but less rigorous equation without correction for the image potential has the same basic form.) Since the field emitted current I J, and E V, a plot of $\ln(I/V^2)$ as a function of (1/V) yields an approximately straight line whose slope $$\propto -6.83 \times 10^7 \frac{\phi^{3/2}}{\beta}.$$

Thus with an automated microcomputer control process, the whiskers can be regenerated to a given enhancement factor $\beta$ or a given emission rate during regular off-intervals of the device. Conversely, if the enhancement factor has not changed after being determined, this slope can be used to ascertain the work function $\phi$.

Figure 11:
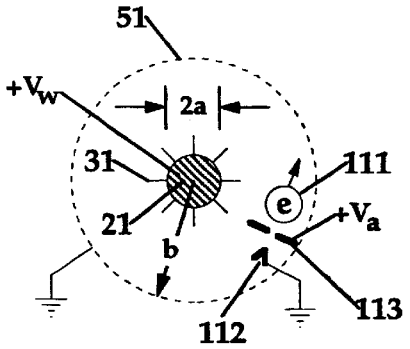
FIG. 11 is a transverse cross-sectional view of the cathode element of FIG. 5, operating in a whisker growing mode by means of emitted orbiting electrons.
Figure 8:
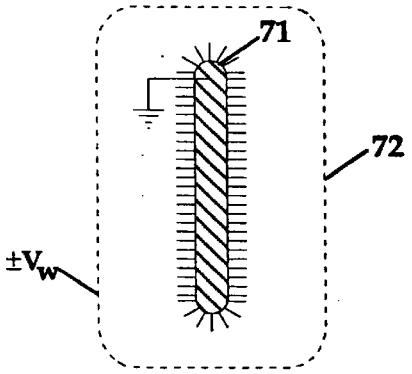
FIG. 8 is a transverse cross-sectional view of the cathode element of FIG. 7, operating in a whisker growing and emissive checking mode.
Figure 9:
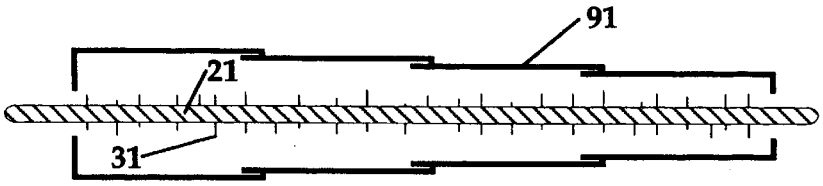
FIG. 9 is a longitudinal cross-sectional view of a cathode element whisker-covered wire surrounded by telescoping coaxial cylinders.

While it is clear that whisker regeneration at regular intervals is a very desirable aspect of this invention, it should also be borne in mind that this invention can be used for initial growth of whiskers on the cathode both in the radial electric field of the cylindrical geometry shown in FIGS. 6, 9, and 11 as well as in the approximately uniform macroscopic field established throughout most of the space of the geometry of FIG. 8. The main difference is that initial growth takes a longer period of time. An advantage to using this invention for initial growth of whiskers is that after the whiskers are grown, the cathode can be coated in-situ with a low work function material. This avoids oxidation and other problems related to introducing whisker-coated and/or low work function coated wire into envelope 16 of FIG. 1.

During whisker regeneration or growth, application of a negative voltage $-V_W$ to the outer cylindrical grid 51 of FIG. 6 permits the whisker to grow without electron emission, and thus eliminates the power consumption (whisker emission current times $V_W$) during the growing process. However, a positive voltage $V_W$ must be applied to the outer cylindrical grid 51 to ascertain the emission current. Otherwise, the cylindrical grid 51 may be either at a positive or negative voltage $\pm V_W$ with respect to the wire 21.

Figure 7:
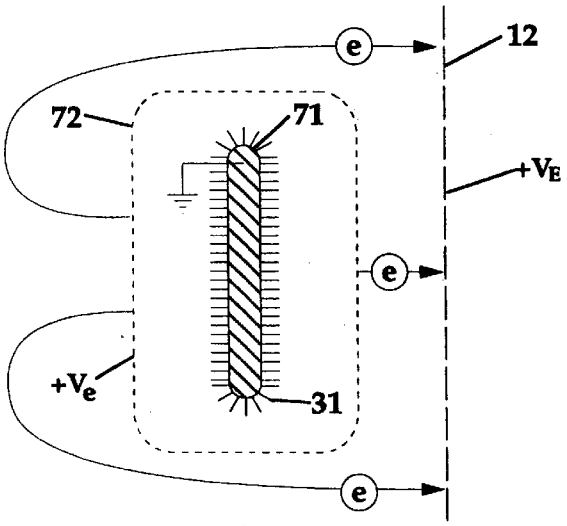
FIG. 7 is a transverse cross-sectional view of a whisker-covered emissive ribbon surrounded by a transparent mesh rectangular penultimate electron extractor grid with electrons directed to the ultimate extractor grid.

FIG. 7 is a transverse cross-sectional view of a cathodic emissive ribbon 71, covered by whiskers 31, and surrounded by a transparent mesh, rectangular, penultimate electron extractor grid 72 at a positive voltage $+V_e$ with respect to the cathode. This configuration is similar in mode of operation to that described for FIG. 5, except that here an approximately uniform electric field is established throughout most of the space between the cathode and grid rather than the radial electric field of FIG. 5. As in the device of FIG. 5, the ultimate extractor grid 12 accelerates the emitted electrons towards the addressing grids 13 and 14 of FIG. 1, and not only directs those electrons that are initially aimed toward it, it also diverts those electrons which are aimed away from it. The ultimate extractor grid 12 has voltage $+V_E$ on it which is > than the extractor voltage $+V_e$ on the penultimate extractor grid 72, in accord with the Langmuir-Child law as previously discussed. The applications and benefits of this configuration are similar to those already described in conjunction with FIG. 5, except that the embodiment of FIG. 5 is preferred for ease of enhancement of the electric field on the cathode.

FIG. 8 is a transverse cross-sectional view of the cathode element of FIG. 7, operating in a whisker growing and emissive checking mode. This configuration is similar to that of FIG. 6 in mode of operation, except that here an approximately uniform electric field is established throughout most of the space between the cathode and grid 72 rather than the radial electric field of FIG. 6. As described in conjunction with FIG. 6, whiskers may be regenerated or grown ab initio in this embodiment just as in the embodiment of FIG. 6 with only the application of a voltage $\pm V_W$ to the grid 72, or preferably the combination of this applied electric field and heating of the ribbon 71. For the purpose of ease of enhancement of the electric field on the cathode the embodiment of FIG. 6 is preferred. As in FIG. 6, application of the electric field here in the embodiment of FIG. 8 serves to align the whiskers in the direction of the electric field.

FIG. 9 is a longitudinal cross-sectional view of one element of a cathode array showing a wire 21 covered by whiskers 31 surrounded by telescoping coaxial cylinders 91. The extended telescope configuration shown, is primarily for whisker growth and/or regeneration as described in conjunction with FIG. 6. The cylinders may be in the form of a transparent grid mesh or continuous for the whisker growing mode. In the case of a transparent grid mesh for the telescoping coaxial cylinders 91, they may remain extended during operation of the configuration for thermo-field assisted emission as an element of a cathode array as described in conjunction with FIG. 5.

Figure 10:
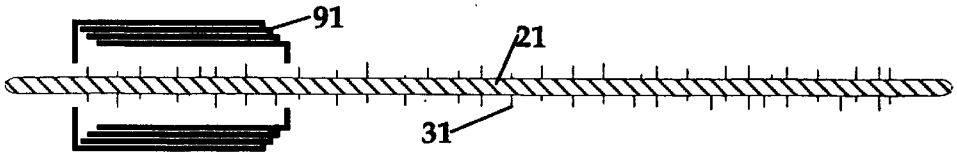
FIG. 10 is a longitudinal cross-sectional view of the cathode wire of FIG. 9, with the coaxial cylinders in contracted (collapsed) position, exposing the whisker-covered wire.

FIG. 10 is a longitudinal cross-sectional view of the wire 21 covered by whiskers 31 of FIG. 9, with the telescoping coaxial cylinders 91 in fully collapsed position. For some purposes, the electric field at the wire 21 as enhanced by the whiskers 31 may be sufficiently high without the telescoping coaxial cylinders 91 i.e. without a coaxial penultimate extractor grid such as in FIGS. 5 and 7. So operation in the collapsed position of the cylinders 91 may be desirable. Even for cathodic operation with the cylinders 91 as an extended transparent grid mesh, collapsing them for the purpose of inspection of the wire 21 may be necessary.

FIG. 11 is a transverse cross-sectional view of the cathode element of FIG. 5, wherein the whiskers 31 are grown from the wire 21 of radius a by means of emitted orbiting electrons 111. The electrons 111 are emitted from a filament 112 at ground potential to be accelerated through an apertured anode 113 at radius $r_a$ and voltage $+V_a$, and thus introduced with a given initial momentum into the cylindrically symmetric space. Orbiting electron ion-getter vacuum pumps are well known in the art as described in the patents of Dennis Gabor U.S. Pat. No. 3,118,077, Raymond Herb et al U.S. Pat. Nos. 3,244,990 and 3,244,969, Mario Rabinowitz et al U.S. Pat. Nos. 3,510,712 and 3,588,593, as well as others. However, their use for growing whiskers is novel as taught herein. I have discovered by means of a combination of experiment and theory that a large covering of whiskers with an exceptionally high field enhancement factor can be grown on the wire 21 by proper use of such orbiting electrons as will be described shortly.

In Gabor's patent, the only criterion given for orbiting the electrons is $$r_a\sqrt{V_a} > a\sqrt{V_w}, \tag{11}$$

where $r_a$ is the radius of the apertured anode 113 at voltage $V_a$ in the Gabor device (or the potential near the filament 112 in the Herb device), and a is the radius of the central cylindrical wire 21 anode at voltage $+V_W$. Gabor assumes that the electrons leave the apertured anode 113 with only azimuthal velocity, and hence by conservation of momentum they will not reach-the wire 21 since they are introduced with an angular momentum proportional to $r_a\sqrt{V_a}$ which is greater than the angular momentum proportional to $a\sqrt{V_W}$ they would have at the wire 21.

Both Gabor and Herb et al have based their orbiting criteria on simple idealized criteria. Herb et al consider the idealized case of circular orbits. In general most of the electrons follow cycloidal-like paths with a minimum and maximum radial distance. I have derived more general orbiting criteria for the cycloidal-like paths that allows for both azimuthal and axial introduction of the electrons. Thus I have discovered that to have a long orbiting trajectory, and to avoid capture at the anode 21 for as long as possible, the minimum velocity at which an electron may leave the introduction region at the angle $\phi$ with respect to a radial line from the central axis to the apertured anode 113 is $$v > \left[\frac{2ea^2(V_w - V_a)}{m(r_a^2\sin^2\phi - a^2)}\right]^{1/2}, \tag{12}$$

where e is the electronic charge, a is the radius of the wire 21 (central anode), $V_W$ is the voltage of the wire, m is the mass of an electron, and $r_a$ is the radial distance from the axis of the wire 21 to the apertured anode 113 at voltage $V_a$. The velocity v is determined by the voltage $V_a$:

$$v = \left[\frac{2eV_a}{m}\right]^{1/2}, \tag{13}$$

in accord with eq. (12).

One must also avoid escape orbits which make one pass around the central anode and then are captured at the cathode outer cylinder 51. I have found that to avoid capture at the outer cylinder 51, the maximum electron velocity cannot exceed $$v < \left[\frac{2eb^2V_a}{m(b^2 - r_a^2\sin^2\phi)}\right]^{1/2}. \quad (14)$$

Therefore the optimum electron velocities, v, for long orbits must be in the range $$\left[\frac{2ea^2(V_w - V_a)}{m(r_a^2\sin^2\phi - a^2)}\right]^{1/2} < \left[\frac{2eV_a}{m}\right]^{1/2} < \left[\frac{2eb^2V_a}{m(b^2 - r_a^2\sin^2\phi)}\right]^{1/2}. \quad (15)$$

For growing whiskers, the temperature of the surface of the wire 21 is preferably elevated to between 0.5 and 0.8 of the melting temperature of the wire, $T_{melt}$, on an absolute temperature scale such as degrees Kelvin, K. This may be done by resistive heating of the anode wire 21 (which after the whiskers are grown will be used as the emissive cathode), and/or by non-orbiting electrons in a mode where they do not obey the orbiting criteria. For electron bombardment of the anode wire 21 where the electrons fall into the anode wire 21 without any orbiting, the maximum electron velocity cannot exceed $$v < \left[\frac{2ea^2(V_w - V_a)}{m(r_a^2\sin^2\phi - a^2)}\right]^{1/2}. \quad (12)$$

After a temperature of 0.5 $T_{melt}$ to 0.8 $T_{melt}$ is attained on the surface of the wire 21, whisker growth is initiated on the surface of the wire 21 with the orbiting electrons obeying the criteria of eq. (15). Abundant whisker growth with a large field enhancement factor results. Although I have ascertained that this method and apparatus is quite effective in growing whiskers, it is not clear why this is so. The long mean free paths of the orbiting electrons in colliding with the vapor of the wire 21 can produce positive ions, induce polar moments in the vapor atoms, and produce negative ions. Positive ions are repelled from the anode wire 21 and attracted to the cathode cylinder 51 so this is not expected to help grow whiskers. Although negative ions formed by electron attachment to the neutral vapor atoms would help grow whiskers since negative ions would be attracted to the anode wire 21 and in particular to nascent whiskers 31, this does not seem to be a likely process. A more likely process may be the polar moments induced both by electron collision and by the high radial electric field gradient between the cylinders 21 and 51 and the even higher electric field gradient near the tips of nascent whiskers. In a uniform electric field, there is no net force on a polarized atom. However, if the electric field has a gradient, then there is a net force. Thus the wire 21 attracts polar atoms towards it, and as a polarized atom gets near a nascent whisker, there is an even stronger attraction to the tip of the whisker. Of course as the nascent whisker grows, this force gets larger advantageously bringing more vapor atoms to whisker tips than to the wire base.

Figure 12:
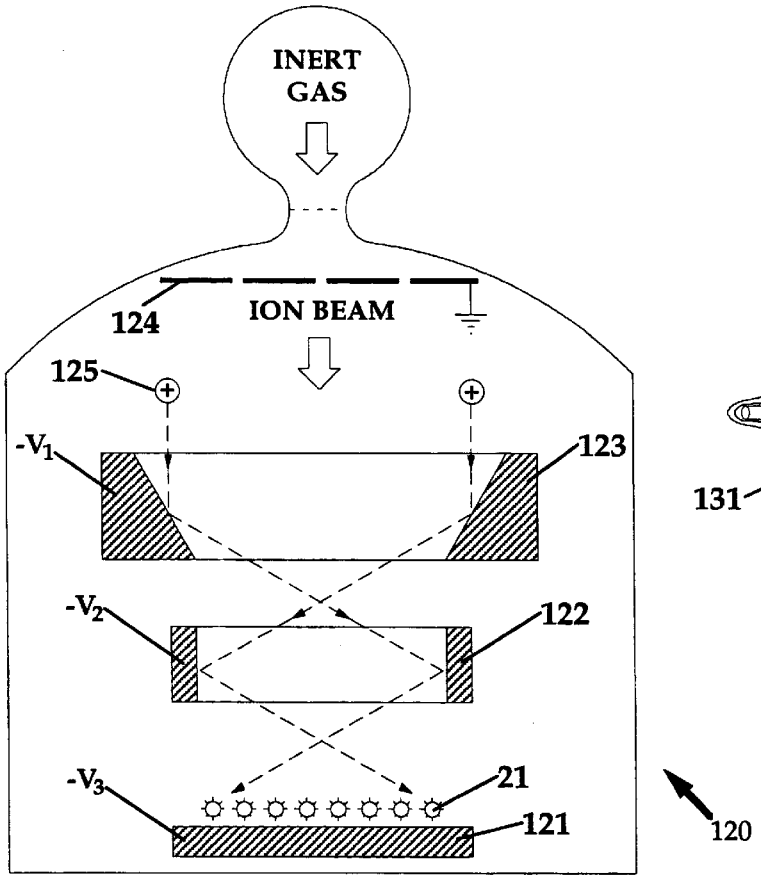
FIG. 12 is a transverse cross-sectional view of an alternate whisker forming ion-sputtering apparatus showing the relative positions of the various components.

FIG. 12 is a transverse cross-sectional view of a whisker-forming ion-sputtering apparatus 120 whose target support 121 holds the final target cathode array wires 21 (or equivalently the cathode ribbon of FIG. 7) at voltage $-V_3$ and above which are annular beveled auxiliary target 122 at voltage $-V_2$, and annular auxiliary target 123 at voltage $-V_1$. The bevel angle of target 122 is preferably in the range 30° to 50° with respect to a line from the ion beam source to the final target 121. Positive ions 125 are accelerated by the potential between the ground plate 124 and the first target 123 striking it mainly at glancing angles as shown. Neutralized plasma ions and sputtered atoms from target 123 together with unneutralized ions go on to strike target 122 also mainly at glancing angles as shown. Sputtering is more effective when the incident ions or atoms strike a target at glancing angles, and if the incident particles closely match or exceed the mass of the target atoms. This is why the sputtering apparatus 120 has two auxiliary targets 122 and 123 to achieve this goal, although for many purposes one auxiliary target will suffice. The target voltages are $-V_3 \leqq -V_2 \leqq -V_1$. The purpose of sputtering the wires 21 on the final target 121 is to form whiskers or nascent whiskers.

Because of its high melting point, low vapor pressure, and high tensile strength, tungsten is a preferred material as the wire 21 for most cathode purposes. Tungsten's atomic weight of 184 puts it at the high end of atomic masses. This makes it relatively difficult to sputter it with much lighter ion beams such as an argon beam. It is advantageous to use inert gases for the ion beam so that it will not produce undesirable reactions with the cathode wires 21. Table 11 lists several medium to heavy inert gases, indicating their atomic number Z and atomic weight A that can be used for a sputtering ion beam. When everything else is equal, a radon ion beam would be preferred for sputtering tungsten since radon's atomic weight of 222 approximates the atomic weight of tungsten which is 184. Of course, other materials may also be used for the cathode wires 21.

TABLE 11

Medium to Heavy Inert Gases for Ion Beam

| Gas | Z | A |
|---|---|---|
| Argon | 18 | 39.9 |
| Krypton | 36 | 83.7 |
| Xenon | 54 | 131.3 |
| Radon | 86 | 222 |

The auxiliary targets 122 and 123 are present to increase flexibility in the choice of ion beam and to more effectively sputter the wires 21 for the purpose of forming whiskers or nascent whiskers. Thus target 123 is made of one material and target 122 made of another material composed, for example, of progressively higher atomic weight so that the atomic weight of the final target (the wires 21) may be approached serially from ion beam to target 123 to target 122 to final target 21. Target 123 is beveled as shown in FIG. 12, so that the bulk of the scattered ions and atoms strike the inner part of target 122 as shown. The bulk of the scattered ions and atoms from target 122 strike the wires 21 as the final target on the target support 121 to form whiskers.

Examples of desirable materials for the targets 122 and 123 are heavy metals with fairly low work functions as shown in Table 12. A high melting point is also desirable, as it is important to avoid melting of the intermediate auxiliary targets 122 and 123. In the case of cesium with a melting point of only 28.5° C., which is moderately heavy and has an exceptionally low work function, melting can be avoided by forced water cooling of the auxiliary target. All three targets 123, 122, and 21 are concurrently exposed to a low pressure ion beam plasma. For example, a dc voltage $-V_1$ of about −1000 to −2000 V is maintained between the the ground plate 124 and the first target 123 during ion beam bombardment, with similar steady or transient voltages $-V_2$ and $-V_3$ for targets 122 and 21. Ion current densities ~10 mA/cm$^2$, can produce a fairly uniform density of nascent whiskers in ~ day for many materials. Some methods for increasing the enhancement factor by growing whiskers from nascent whiskers are described in conjunction with FIGS. 6, 8, and 11.

TABLE 12

Fairly Low Work Function, Heavy Metals

| Metal | Z | A | $T_{melt}$, ° C. | ϕ, eV |
|---|---|---|---|---|
| Barium | 56 | 137.4 | 850 | 2.1 |
| Cesium | 55 | 132.9 | 28.5 | 1.8 |
| Lanthanum | 57 | 138.9 | 826 | 3.3 |
| Thorium | 90 | 232.1 | 1845 | 3.35 |

Figure 15:
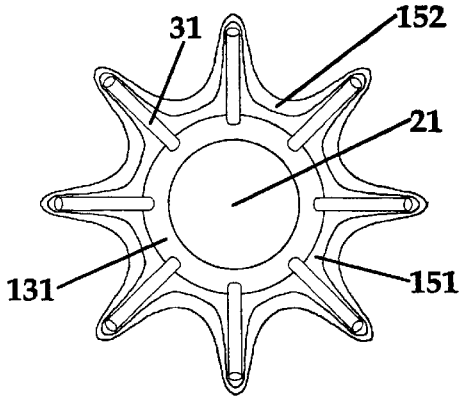
FIG. 15 is a transverse cross-sectional view of the completed whisker cathodic structure of FIGS. 13 and 14 showing the final whisker bonding.

Examples of less desirable but usable materials for the targets 122 and 123 are heavy metals with medium to high work functions as shown in Table 13. As long as the bombarding species are effective in forming whiskers (or nascent whiskers) it is not critical that they form a low work function surface on the wires, as this can be done by coating the wires after the whiskers are grown. For example, titanium and tin readily grow very long whiskers of very high enhancement factor. Tin has a work function of 3.6 eV which is barely acceptable, but its melting point of 232° C. is far too low. Titanium (like many other metals) is not as desirable a cathode material as tungsten for a number of reasons such as titanium's relatively low melting point of 1800° C., moderately high (relative to tungsten) vapor pressure of $10^4$ Torr at 1500° C., and its work function of 4 eV is relatively high compared to many materials. However, it is possible to coat tungsten wire (or some other favored material) with titanium (Z=22 and A=47.9), grow very large enhancement whiskers, and then coat them with a lower work function material, whose work function does not exceed 3.6 eV, so that it can operate at moderate temperature in the thermo-field assisted mode as taught in the instant invention. If for example, the final target is a soft metal like copper, which readily forms a dense array of whiskers, it is desirable to put an evaporated overcoat of a tough metal like tungsten on to give the whiskers strength, followed by a second overcoat of a low work function metal as shown in FIG. 15. Low work function coating is preferably done in situ in vacuum in the final device in which the cathode will be utilized.

TABLE 13

Medium to High Work Function, Heavy Metals

| Metal | Z | A | $T_{melt}$, ° C. | ϕ, eV |
|---|---|---|---|---|
| Gold | 79 | 197.2 | 1063 | 4.0–4.6 |
| Hafnium | 72 | 178.6 | 2207 | 3.5 |
| Molybdenum | 42 | 96 | 2620 | 4.2 |
| Osmium | 76 | 190.2 | 2700 | 4.6 |
| Tin | 50 | 118.7 | 232 | 3.6 |
| Tungsten | 74 | 183.9 | 3370 | 4.25–4.6 |

Figure 13:
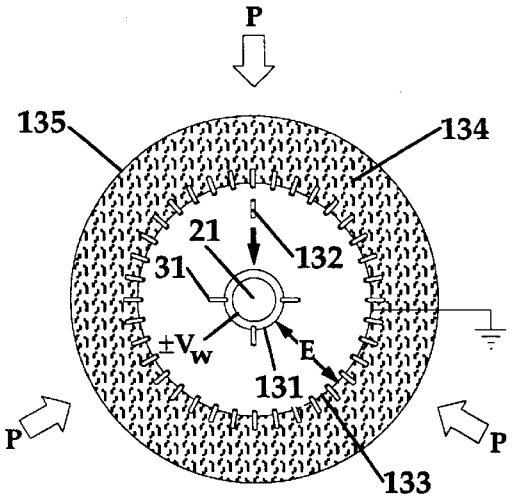
FIG. 13 is a transverse cross-sectional view of a whisker transplanting and bonding electrical apparatus showing the relative positions of the various components.
Figure 14:
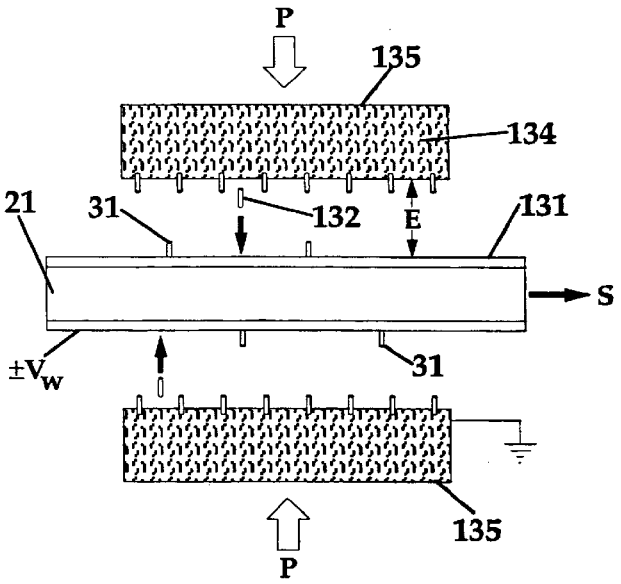
FIG. 14 is a longitudinal cross-sectional view of the whisker transplanting and bonding apparatus of FIG. 13.

FIGS. 13, 14, and 15 illustrate (not-to-scale) whisker transplanting and bonding apparatus showing the relative positions of the various components. Whiskers are grown readily by some materials, and less readily on others. For example, in my experiments I have readily grown whiskers on titanium, niobium, and lead; and whiskers easily grow on tin without need for special conditions at ambient temperature. The most easily made whiskers are nanotubes that are free (unbound) whiskers that are readily made by the pound. Nanotubes can be either closed or open-ended. Closed versions are capped by hemi-fullerenes. Some scientific papers about nanotubes are: a) "Single-shell carbon nanotubes of 1-nm diameter," S. Iijima and T. Ichihashi, Nature 363, p. 603, Jun. 17, 1993; b) "Cobalt-catalysed growth of carbon nanotubes with single-atomic-layer walls," D. S. Bethune et al, Nature 363, p. 605, Jun. 17, 1993; c) "Structural Properties of a Carbon-Nanotube Crystal," J. Tersoff and R. S. Ruoff, Physical Review Letters 73, p. 676, Aug. 1, 1994. Nanotubes may easily have electric field enhancement factors of >1000, being ~10,000 nm in length and ~10 nm in diameter. Nanotubes may be easily made with a low voltage arc between graphite electrodes surrounded by He gas at 500 Torr (500/760 atmospheric pressure). It will next be shown how a harvest of nanotubes or any other kind of free (unbound) whiskers can be electrically transplanted and bonded to an electrode.

FIG. 13 is a transverse cross-sectional view of whisker transplanting and bonding apparatus in which a voltage $\pm V_W$ is applied to a wire 21 having a thin coating or shell 131 of a relatively soft material which may be a soft metal like copper or aluminum or even a plastic like polytetrafluoroethylene (TFE, tradename teflon), that thus acts as a penetrable target for projectile whiskers 132. These projectile whiskers 132 become embedded in the soft shell 131, and thus later will be able to serve as cathodic bound whiskers 31. The analysis with respect to tensile strength in conjunction with FIG. 6 indicates that there is a force acting to pull whiskers out parallel to the electric field and accelerate them to the wire 21. A higher magnitude voltage $V_W$ is needed the harder the shell 131. A coaxial cylindrical filter 133 at ground potential surrounds the wire 21. For most whiskers and in particular nanotube whiskers, it has been found that a pore size no greater than 200 nm works quite well for the filter 133.

Since this cylindrical filter 133 also acts as an electrode, if it is not made of a conducting material then it may be coated with a metal while pressurized gas flows through the pores to prevent pore clogging during the coating process. Even if the filter 133 is made of ceramic that is intrinsically non-conducting and not metal coated, it forms a conducting inner surface by the contiguity of the conducting free whiskers 134 which are packed around it and also protrude through the pores. Radial pressure P is applied (e.g. by hydrostatic means) across an elastic membrane 135 forcing free whiskers 134 through the pores of the filter 133. It has been empirically found that this preferentially pushes free whiskers 134 out perpendicular to the filter surface as shown. However such a radial mechanical alignment of the free whiskers 134 with the radial electric field is not critical, as the radial electric field not only accelerates the projectile whiskers 132 across the gap, but tends to align them radially as they come out of the pores as shown by the whiskers 134 coming out of the pores of the filter 133 and as illustrated by the whisker projectile 132. A similar process would occur for a uniform electric field configuration such as is shown in transverse cross section in FIG. 8, with a ribbon 71 replacing the wire 21; and the use of a filter with a rectangular-like cross section.

Alignment and acceleration of the free whiskers 134 occurs whether the voltage on the wire 21 is + or $-V_W$, and either polarity may be used. If $+V_W$ is applied to the wire 21, then the projectile whiskers 132 are negatively charged with electrons as they leave the filter 133 and may lose charge by field emitting electrons as they traverse the gap, thus decreasing their acceleration. If $-V_W$ is applied to the wire 21, then the projectile whiskers 132 are positively charged as they leave the filter 133, cannot field emit, and are less likely to reduce their net charge during traversal of the gap. In any case, a negative voltage $-V_W$ needs to be applied to the wire 21, as it becomes covered with bound whiskers 31 to check its progress in enhancing the field to later serve either as a field emission or thermo-field assisted cathode in a device such as a flat panel display.

FIG. 14 is a longitudinal cross-sectional view of the whisker bonding apparatus. It may depict either the cylindrical structure of FIG. 13 with a wire 21, or a more uniform electric field structure such as is shown in transverse cross section in FIG. 8, with a ribbon 71 replacing the wire 21. In either case, the ribbon or wire 21 is moved axially at a speed S as shown, through the region of electric field E. Three variables serve to control the rate and density of whisker deposit. These are the electric field E, the speed S, and the radial pressure P. The variable P serves to allow E not to be too large as this could pull bound whiskers 31 out of the soft shell 131, before the bound whiskers 31 are cemented in place by the overcoat 151 described in conjunction with FIG. 15. As explained in connection with FIG. 4, a large density (close separation) of whiskers (e.g. nanotubes) is desirable to increase the total emission current as long as the separation between whiskers d>10r. At separations (d) between whiskers closer than 10 tip radii (10r), there is an interference between the enhanced microscopic field of each whisker. For example, in the limit of contiguous whiskers of the same height, there would be no enhancement of the electric field.

The values of E, S, and P to produce optimum coverage of whiskers 31 on the wire 21 may be determined by observation of the wire surface with a scanning electron microscope. Or, the optimum coverage of whiskers 31 on the wire 21 may be determined by operating the wire 21 as a cathode and the filter 133 as an anode in the field emission mode. As long as the field emission current increases for a given applied voltage $-V_W$, the density of bound whiskers 31 has not exceeded the optimum value. When further coverage of bound whiskers 31 on the wire 21 starts to decrease the field emission current, the optimum has been slightly exceeded, and this is a good stopping point.

FIG. 15 is a transverse cross-sectional view of a completed cathodic structure 150 showing the wire 21, covered with bound whiskers 31 embedded in a soft shell 131. Both to increase electrical conductivity, and to increase bonding to the shell 131 (and hence the wire 21) a thin overcoat 151 is deposited over the bound whiskers 31 and shell 131. The material 151 is preferably of low work function as discussed in connection with FIGS. 5 and 12 to further increase the emission capability of the cathode 150. If necessary, a first overcoat 151 may be applied for strength, and a second overcoat 152 for low work function. When the bound whiskers 31 are nanotubes, the strong capillary action of the nanotubes will draw in the overcoat 151 to their interior, thus aiding in the bonding process. The first and second overcoats as described here, may be applied after generation of whiskers by any of the other processes.

While the invention has been described with reference to preferred and other embodiments, the descriptions are illustrative of the invention and are not to be construed as limiting the invention. Thus, various modifications and applications may occur to those skilled in the art without departing from the true spirit and scope of the invention as summarized by the appended claims.

What is claimed is:

1. A method for generating whiskers comprising the steps of:

(a) introducing electrons into spiralling orbits in a vacuum annular electric field space, said space being defined by a first linear electrode as an anode and a second surrounding coaxial cathodic electrode;

(b) applying a voltage between the said first and second electrodes that establishes the said electric field between them; and (c) capturing said electrons at said first electrode.

2. The method of claim 1, comprising the additional step of providing for heating to be applied to said first electrode.

3. The method of claim 1, comprising the additional step of providing for heating of said first electrode to occur by said capture of said emitted electrons.

4. The method of claim 1, comprising the additional step of providing for the generation of whiskers on said first electrode to result from collisions of said electrons with vapor from said first electrode.

5. The method of claim 1, comprising the additional step of providing for emittion of said electrons through an apertured anode to fills the annular space between the said first and second electrodes with orbiting electrons.

6. The method of claim 5, comprising the additional step of providing for voltages to be applied to cause the said emitted electrons to go into spiraling orbits with said voltages being defined by the relationship $$\left[\frac{2ea^2(V_w - V_a)}{m(r_a^2\sin^2\phi - a^2)}\right]^{1/2} < \left[\frac{2eV_a}{m}\right]^{1/2} < \left[\frac{2eb^2V_a}{m(b^2 - r_a^2\sin^2\phi)}\right]^{1/2},$$

where e is the charge of an electron, m is the mass of an electron, $V_W$ is the voltage on said first electrode, $V_a$ is the voltage on the apertured anode, $r_a$ is the radial distance of the apertured anode from the axis of the said first electrode, $\phi$ is angle of the electron velocity vector with respect to a radial line from the central axis to the apertured anode, a is the radius of the said first electrode, and b is the radial distance of the said cathodic electrode from the axis of the annular space.

7. The method of claim 5, comprising the additional step of providing for heating of the said first electrode to be accomplished by the said emitted electrons having a velocity $$v < \left[\frac{2ea^2(V_w - V_a)}{m(r_a^2\sin^2\phi - a^2)}\right]^{1/2},$$

where e is the charge of an electron, m is the mass of an electron, $V_W$ is the voltage on said first electrode, $V_a$ is the voltage on the apertured anode, $r_a$ is the radial distance of the apertured anode from the axis of the said first electrode, $\phi$ is the angle of the electron velocity vector with respect to a radial line from the central axis to the apertured anode, and a is the radius of the said first electrode.

8. A method for generating whiskers for an enhanced electric field on a cathode, comprising the steps of (a) forming an ion beam of heavy inert gases;

(b) applying a negative voltage $-V_1$ to a first annular target of atomic weight $A_1$, causing ion sputtering of said first target by said ion beam;

(c) applying a negative voltage $-V_2$ to a second annular target of atomic weight $A_2$, causing ion sputtering of said second target by said ion beam and products from the first target;

(d) applying a negative voltage $-V_3$ to a a final target of atomic weight $A_3$, causing ion sputtering and whisker generation on said final target by said ion beam and products from the first and second targets;

(e) choosing said atomic weights to be approximately equal to comply with the relationship $A_3 \geqq A_2 \geqq A_1$; and (f) choosing said voltages to be approximately equal and to comply with the relationship.

9. The method of claim 8, comprising the additional step of providing for the said first annular target to have a beveled inner surface.

10. The method of claim 8, comprising the additional step of providing for said first annular target to have a beveled inner surface of angle between 30° to 50°.

11. The method of claim 8, comprising the additional step of providing for the final target to be coated with titanium to increase its whisker generating capability.

12. The method of claim 8, comprising the additional step of providing for the final target to receive a final coating with a material whose work function does not exceed 3.6 eV.

13. A method of free whisker-bonding to an electrode comprising the steps of:

(a) providing for containment of the free whiskers at ground potential;

(b) providing a filter electrode forming a separating surface for said free whiskers;

(c) supplying a soft shell surrounding said target electrode; and (d) maintaining a potential $V_W$ at a target electrode which produces an electric field between said filter and said soft shell.

14. The method of claim 13, comprising the additional step of providing for said electric field to accelerate whiskers to the target electrode.

15. The method of claim 13, comprising the additional step of providing for axial containment of said target electrode inside a topologically cylindrical conductive sheath filter electrode.

16. The method of claim 13, comprising the additional step of providing for application of pressure to force whiskers out of said filter electrode.

17. The method of claim 13, comprising the additional step of providing for movement of said target electrode relative to the filter electrode to provide control over whisker coverage density.

18. The method of claim 13, comprising the additional step of providing for employment of the combination of electric field, pressure, and motion of said target electrode to result in desired coverage of whiskers on said target electrode.

19. The method of claim 13, comprising the additional step of providing for coating said target electrode and embedding whiskers therein to increase the strength of the whisker bond to the target and electrical conductivity of the target.

20. The method of claim 13, comprising the additional step of providing for coating over the said first electrode with a low work-function material to increase the electron emissivity.

* * * * *